United States Patent [19]

Schultz

[11] Patent Number: 4,964,448

[45] Date of Patent: Oct. 23, 1990

[54] RAISED PANEL CUTTER ASSEMBLY

[76] Inventor: David A. Schultz, R. D. 5, Box 59, Balatie, N.Y. 12184

[21] Appl. No.: 407,175

[22] Filed: Sep. 14, 1958

[51] Int. Cl.[5] ..... B27G 13/12

[52] U.S. Cl. ..... 144/223; 83/838; 144/218; 144/373; 144/375

[58] Field of Search ..... 83/835, 838, 676; 144/218, 223, 363, 373, 375

[56] References Cited

U.S. PATENT DOCUMENTS

| | | | |
|---|---|---|---|
| 133,463 | 11/1872 | Long | 144/223 |
| 318,596 | 5/1885 | Buell | 144/223 |
| 374,671 | 12/1887 | Goodhue | 144/223 |
| 395,526 | 1/1889 | Totman | 144/223 |
| 783,946 | 2/1905 | Gregory | 144/223 |
| 3,976,112 | 8/1976 | Rowlson et al. | 144/223 |

*Primary Examiner*—Frank T. Yost
*Assistant Examiner*—Kenneth E. Peterson
*Attorney, Agent, or Firm*—Eugene Chovanes

[57] ABSTRACT

A cutter assembly for forming a raised wooden panel having secured together a saw blade and a winged cutter body. The blade has a substantially greater number of teeth than the number of cutter wings, whereby a greater number of chip loads can be removed at the raised portion of the panel per revolution of the assembly than at the portion formed by the wings. The assembly forms a smooth cut.

3 Claims, 3 Drawing Sheets

RAISED PANEL CUTTER ASSEMBLY

BACKGROUND OF THE INVENTION

This invention relates to a tool or cutter for cutting wood or wood products in a specific manner. Namely, the cutter of the invention is used to form what are known as raised panels wherein a panel has at the perimeter thereof a sloping or tapered portion from a raised interior portion to a thinner perimeter edge.

Raised panels may be in a variety of shapes including most often a rectangular shape, but in some instances a cathedral, round, oblong, or any other practical shape. Such panels are used, for instance, for cupboards, doors, decorative wall coverings, cabinets and furniture. Various types of wood are used, including hard and soft woods and wood products such as molded fiberboards, particle boards, and other composites of wood fibers.

The common feature of all raised panels is a generally sloping or beveled perimeter cut running generally completely around the outer edge of the panel. The slope may be in the form of a flat, inclined surface or, alternately, of a generally undulating design in various forms including bumps, ridges, depressions and convex or concave undulations. The basic feature, however, is that the thickness of the panel at the outer edge is less than the thickness of the panel at the interior raised portion.

In the prior art, a conventional cutter having radially extending wings having cutting tips thereon has been used in forms such as slopes or bevels. The cutter is of generally disk form and operates in a plane parallel to the plane of the panel. If, for instance, the panel extends in a horizontal plane, the cutter also extends in a horizontal plane and is mounted on a vertical rotating arbor. The panel is moved relative to the cutter to successfully form the bevel. Such a procedure is well known.

The profile of the cutter tip on the cutter wing forms the profile of the slope on the finished panel.

A problem in the use of such prior art cutter is that, often, the finished panel has at the intersection of the slope to the raised interior panel portion a torn edge instead of a smooth finished cut which obviously is the desired end effect. Such rough result particularly is obtained when cutting the beveled portion across the grain of the wood. A logical explanation is that the cutter tip on the wing at the extreme end which is cutting the panel at the raised portion is taking too big a bite or chip load since the cutter itself has generally but three wings, so that as the panel is removed relative to the cutter, a substantial portion must be removed from the panel between the wings.

An important factor in the construction of raised panels is the rapidity of speed at which such panels are moved through the cutter. For economic reasons, it is desirable to move such panels rapidly, causing a larger than optimum cut per revolution of the cutter. When the movement of the panel relative to the cutter is slow, to permit less of a cut per revolution of the cutter head, or between successive cuts from the tips on the wings, the panel on the sloping surfaces toward the edge ends up with a "burn" effect since there is over-cutting in that the cutter tip is taking too small a bite. Thus, there is an inherent problem in raised panel cutters in either running the panel through too slowly or too quickly.

SUMMARY OF THE INVENTION

By means of the present invention, there is provided in effect different cutting speeds at the raised panel portion than at the sloping portions toward the perimeter of the panel. This results in different chip loads being imposed on the cutter which then can remove fibers or chips at optimum conditions.

Specifically, the invention provides a greater number of cutting tips at the raised panel portion than at the sloping portions by combining a circular saw blade with a relatively large number of cutting teeth, for instance 24, with a cutter body which has, for instance, three cutter wings with, in effect, three cutting teeth. Thus, at a given rotational cutter speed, for every revolution of the cutter, there are 24 loads of chips removed at the raised panel portion for every three loads of chips removed at the tapered portion. Thus, it is possible to reduce the chip load at the raised panel portion while maintaining the optimum chip load at the sloping portion.

Since the tapered or beveled section of the panel has no edge, it is possible to even overload the cutter at the wing section without any undesirable rough cut resulting. On the other hand, by providing for a greater number of small chip loads at the dividing line in the raised panel section, a very smooth, clean cut can be obtained.

In the cutter of the invention, the circular saw with its relatively great number of teeth is removably secured as by bolting to the cutter body having the relatively small number of wings; for instance, three.

DETAILED DESCRIPTION OF THE INVENTION

Figure 1:
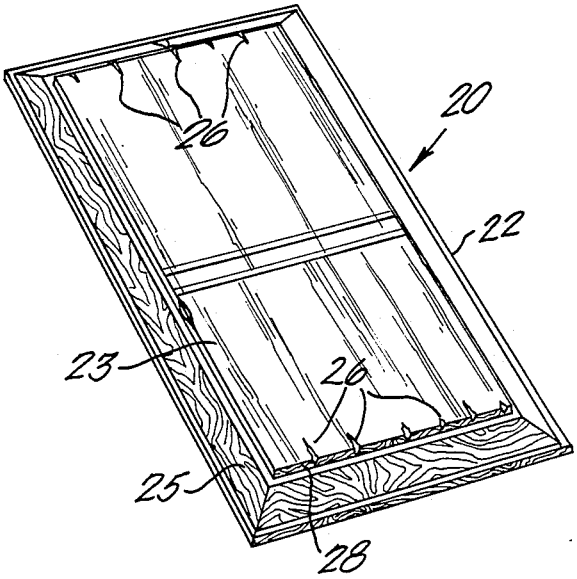
Fig. 1. (prior art)
FIG. 1 is a perspective view illustrating a prior art raised wooden panel. There are shown certain areas of imperfections obtained through conventional methods of manufacturing.

FIG. 1 shows a prior art raised panel 20 of rectangular outline, having a grain running longitudinally of the panel. The panel has a perimeter or outer edge 22. The bevel 25 shown is flat, but it should be understood that such bevel or slope can be such that its cross section would involve undulations such as ridges, depressions, elevations or similar profiles. Such configuration extends uniformly around the perimeter of the panel.

In the prior art, a common problem as seen in FIG. 1 is the relatively rough cut that occurs particularly across the grain as at 26, wherein rough fragments are present.

At the point where the bevel or slope portion 25 meets the raised portion 23, such juncture can be in the form of a vertical rise 28 as seen in FIG. 1, or can be simply the intersection of the raised portions with the sloping portions in a line. Such rough portion occurs, as explained in the Background of the Invention, because in effect the chip load on the cutter is too great and the cutter in effect tears out large portions of fiber rather than cutting relatively smaller portions. Again, as explained above, this occurs because of the relatively large distance between the cutter wings.

Figure 2:
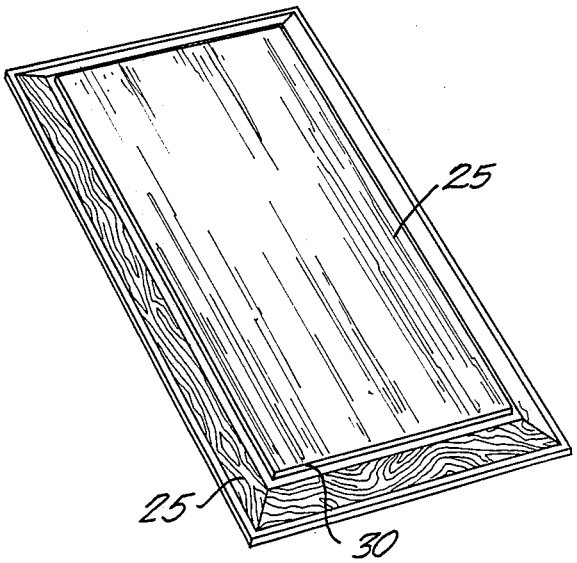
FIG. 2 is a perspective view of a raised panel produced by the raised panel cutter assembly of this invention.
Figure 3:
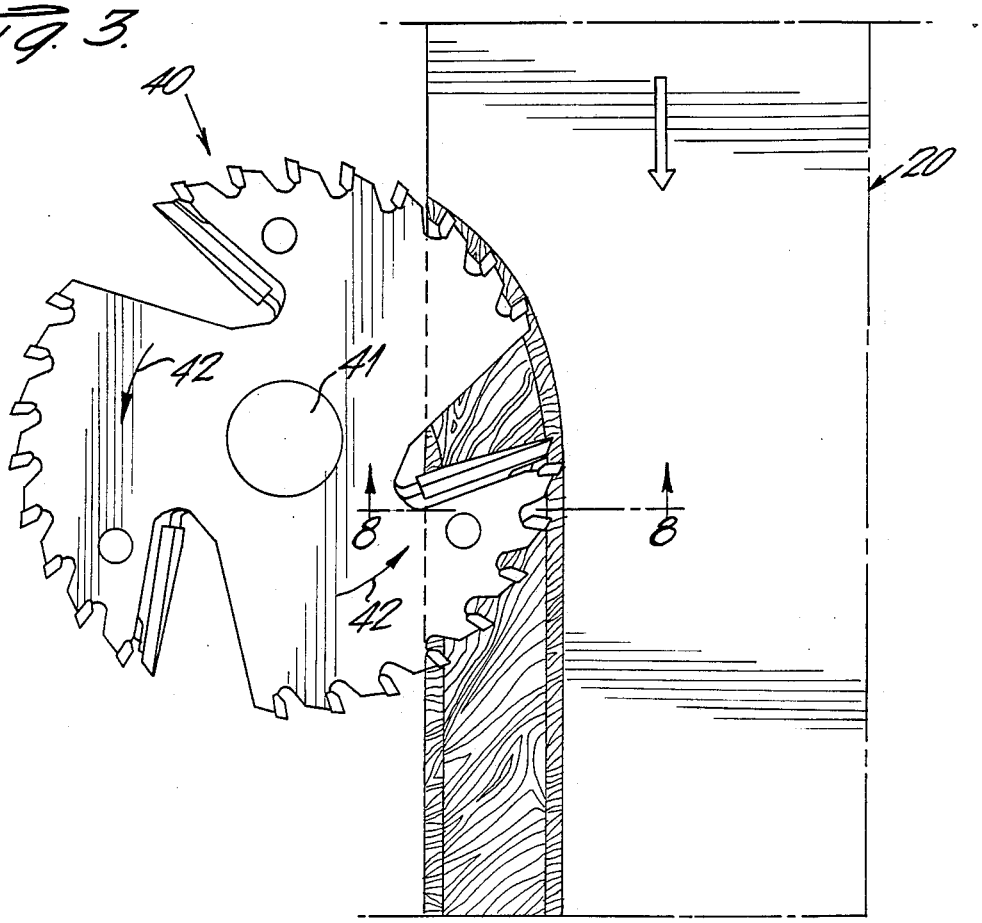
FIG. 3 is a plan view of the cutter assembly of this invention in a cutting mode.
Figure 8:
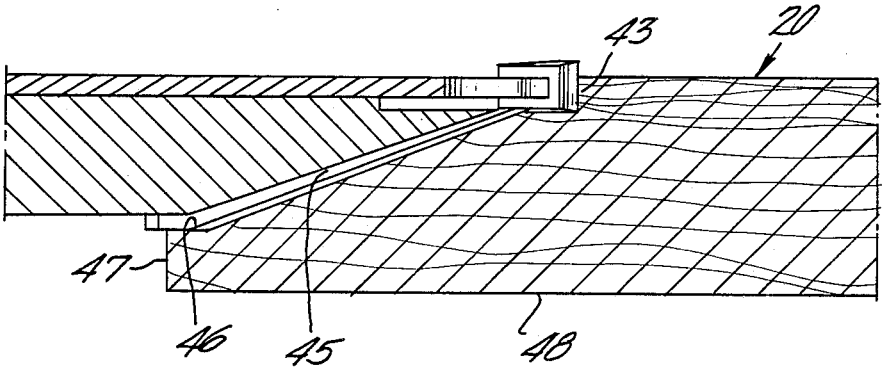
FIG. 8 is an enlarged fragmentary sectional elevational view showing certain details of the cutter assembly and workpiece.

In FIG. 2, there is shown a panel identical to that of FIG. 1 which has been cut with the cutter of the invention. There are no rough fragments as shown in FIG. 1 at 26, but rather, as shown at 30, the juncture of the slope 25 and raised portion 23 is a clean and neat and smooth cut. This result is obtained with a cutter of the invention which is shown particularly in FIGS. 3 through 8. As seen in FIG. 3, the panel 20 moves in the direction 31 with respect to cutter assembly 40 which rotates on shaft 41, which extends vertically and rotates in direction 42, carrying with it cutter assembly 40. As seen in FIG. 8, panel 20 has a rise 43, a slope 45, and a step 46 at perimeter 47. Panel 20 has a bottom surface 48.

Cutter assembly 40 as best seen in FIGS. 4 through 7 has a body portion 50 which is in effect a prior art cutter head. Body 50 has a bore 51, a hub portion 52, and wings 53. Wings 53 have suitably secured thereto as by welding, carbide elements 55 of a conventional prior art type. The carbide tips 55 as best seen in side sectional view in FIG. 7 have a profile which provides the taper 45 in the raised panel 20.

The carbide tips 55 on the cutter wings 53 also provide the step 46 at the perimeter of the panel. The construction of body 50 as described is conventional.

In the cutter assembly 40 of the invention, a saw blade 60 of a diameter conforming to the diameter of the cutter body 50 is fixed thereto as by Allen head screws 61. Saw blade 60 is of a conventional type, except that it is modified to provide a plurality (in this case three) of cutout sections 63 which are in effect enlarged gullets. These provide suitable evacuation spaces for cutter tips 55 and also eliminate any possible interference between the tips 55 and the web of the circular blade 60.

The circular blade 60 has a web portion as well known and a plurality of cutter teeth 62 which are desirably of carbide material suitably sharpened to provide cutting action on the wood panel. It should be understood that the teeth 62 are of conventional prior art sizes and shapes which are, however, selected from known characteristics of the teeth to provide optimum cutting of the particular wood being processed. Such factors include whether the wood is of a hard or soft variety and, where wood products are concerned, the particular makeup of the wood composition. Also, with respect to the wood varieties, factors such as the density of the grain, feed speeds, arbor rotation speeds and other known considerations are taken into account when selecting a suitable saw tooth configuration.

Figure 4:
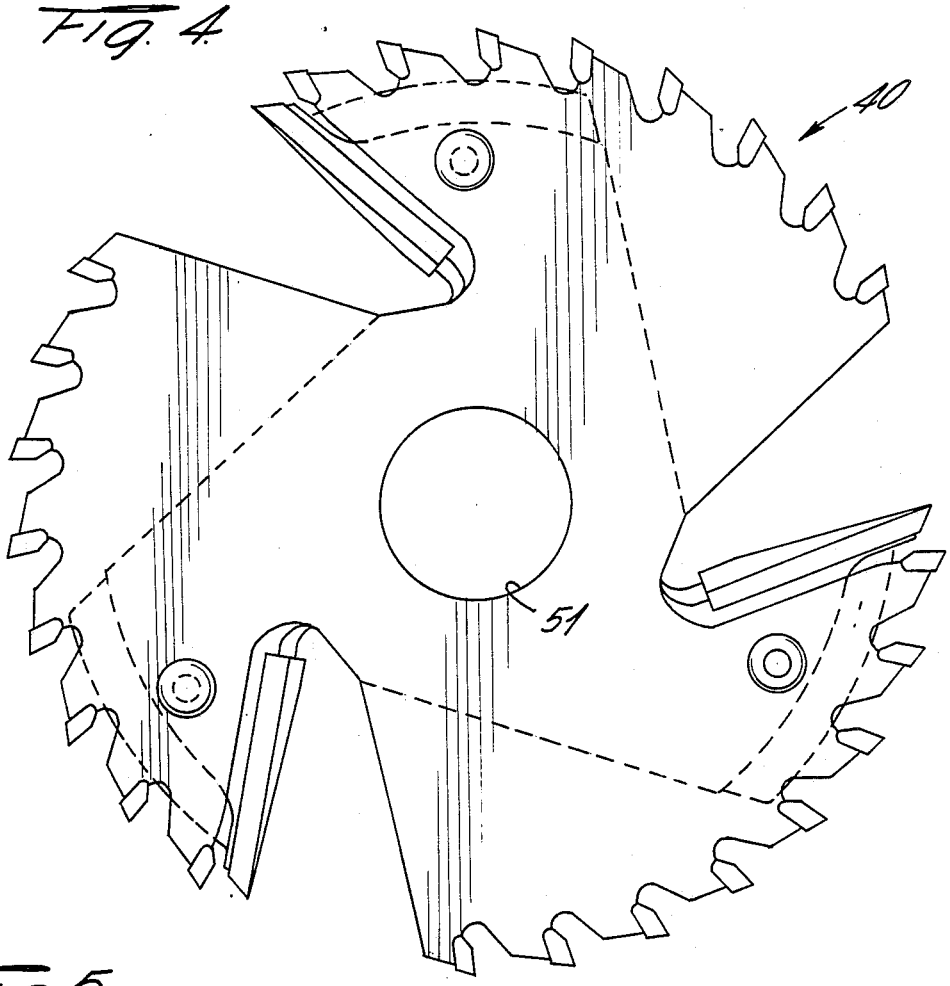
FIG. 4 is a plan view of the raised panel cutter assembly in accordance with this invention.
Figure 5:
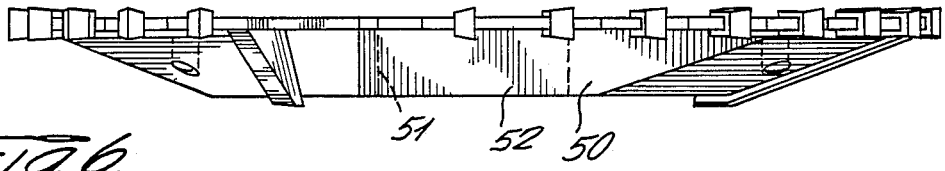
FIG. 5 is a side elevational view of the tool.
Figure 6:
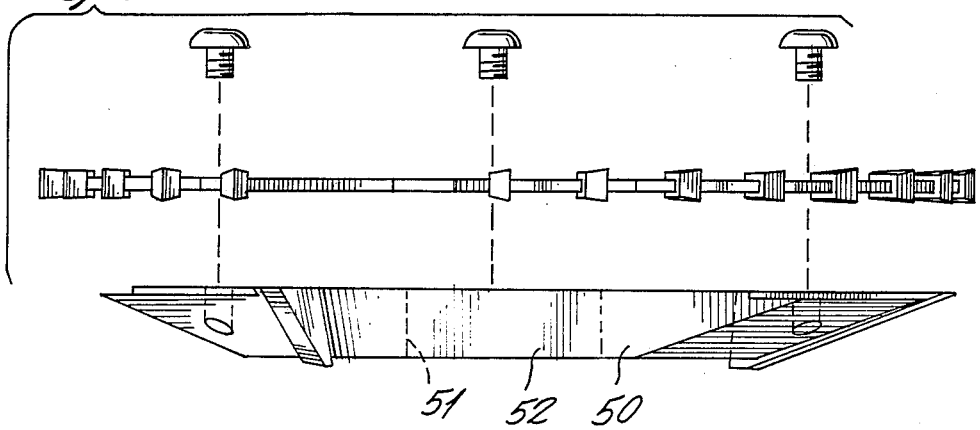
FIG. 6 is an exploded side elevational view of the cutter assembly.
Figure 7:
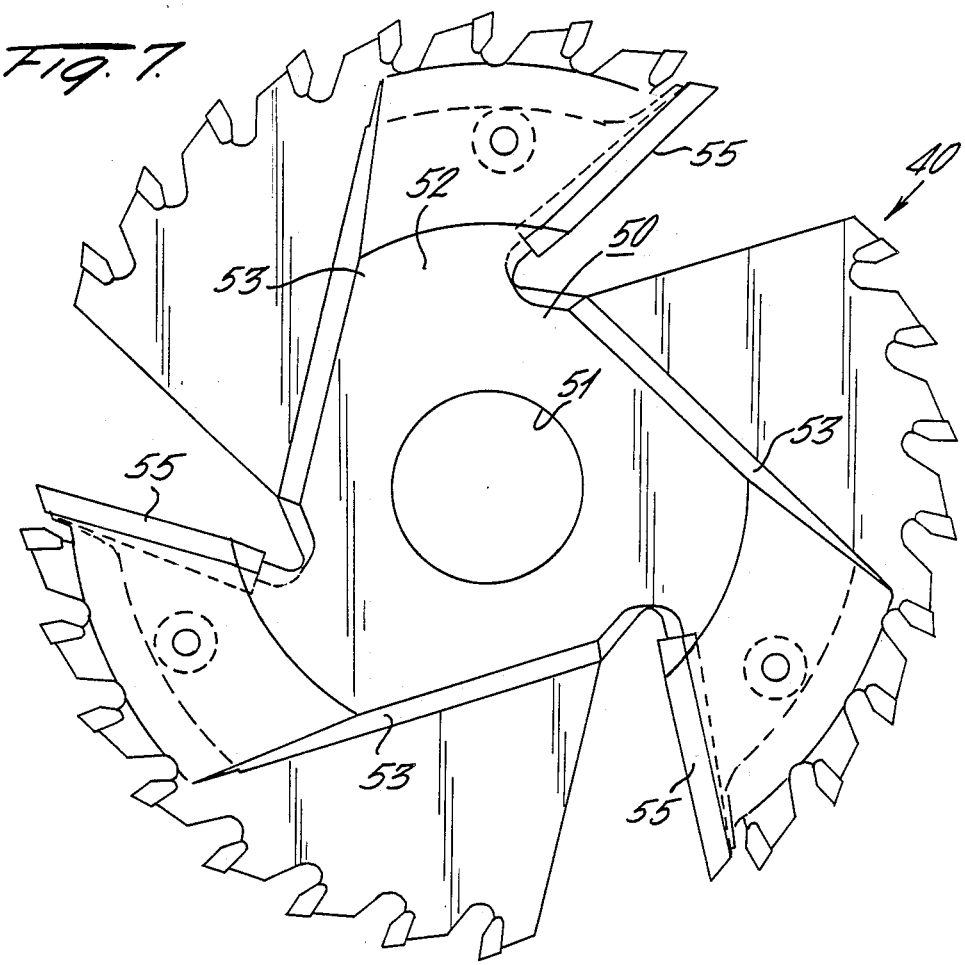
FIG. 7 is a bottom plan view of the cutter assembly shown in FIGS. 3 through 6.

In operation, as seen for instance in FIGS. 4 and 8, the teeth 62 engaged the panel 20 at the raised portion 23, while the carbide cutting tips 55 on the cutter body 50 engage sloped portion 45 and step 46. In the embodiment shown, there are four circular blade teeth 62 between each successive pair of cutter tips 55, so that for every rotation of the cutter assembly 40, four chip loads are removed at rise 43 adjacent to raised portion 23 for every chip load removed by cutter tip 55 on slope portion 45. Thus, the cutter of the invention provides optimum chip removal, depending on the section of the cut being made in the raised panel.

As indicated above, the lower chip load at rise 43 results in a smooth, clean cut at 30 in FIG. 2, and eliminates the problem of a rough surface 26 as seen in FIG. 1.

Thus by means of the present invention, optimum chip loads are removed at different portions of the cut simultaneously during rotation of the cutter assembly 40.

It should be understood that the teeth 62 on the circular saw blade 60 can be formed by grinding into a profile other than the conventional profile in a conventional saw blade, whereby the teeth themselves contribute to a slope profile which is other than a conventional profile having a rise 43.

In alternative embodiments, the saw blade can be made an integral part of the profile itself. For instance, the tooth profile can be formed into an arc which is the continuation of the body 50 profile wherein there can be provided a series of undulations.

It should be understood, however, that even where the saw tooth is optionally profiled from a conventional saw tooth, the essence of the invention remains the same; namely, there are decreased chip loads removed from the panel at the raised portion of the panel than are taken from the sloping portion.

The invention can have particular adaptability where a layer or veneer of wood is laminated to a base portion. In such instances, a saw blade can be selected to provide optimum cutting at the veneer portion, whereas the cutter wings provide the necessary chip removal at the base portion of the veneered panel.

It is stressed that the circular saw blade described and shown has an origin from a conventional blade, but is suitably modified to properly co-act in the assembly. Such modifications include suitable gullets formed circumferentially spaced in the blade to provide chip clearance areas as set forth above for the cutter tips on the cutter body.

I claim:

1. A cutter assembly for forming a raised panel having a generally sloping perimeter, comprising (a) a cutter body having
  (1) a center hub portion extending longitudinally through the cutter body,
  (2) wings of a certain number extending generally radially outward from the hub portion and having a height parallel to the longitudinally extending hub portion,
  (3) said wings decreasing in height radially outward from the hub portion, and (b) a circular saw blade secured to the cutter body, having
  (1) a web portion,
  (2) a plurality of teeth on the perimeter of the web, and
  (3) a plurality of gullets conforming to the cutter wing locations, whereby evacuation spaces are provided for the cutter wings, the number of teeth on the saw blade being substantially greater than the number of wings on the cutter.

2. An assembly of claim 1, wherein the cutter body wings and the saw blade teeth form in the raised panel a sloping rise and a vertical rise on the perimeter of a horizontally positioned raised panel.

3. An assembly of claim 1, wherein the cutter body wings and the saw blade teeth form in the raised panel a continuous uninterrupted surface around the perimeter of the panel.

* * * * *

UNITED STATES PATENT AND TRADEMARK OFFICE

CERTIFICATE OF CORRECTION

PATENT NO. : 4,964,448

DATED : October 23, 1990

INVENTOR(S) : David A. Schultz

It is certified that error appears in the above-identified patent and that said Letters Patent is hereby corrected as shown below:

ON THE TITLE PAGE

Item [76] Address of Inventor - change [Balatie] to: -- Valatie --

Item [22] Change filing date of application from [Sep. 14, 1958] to: -- Sep. 14, 1989 --

Signed and Sealed this

Seventeenth Day of March, 1992

*Attest:*

HARRY F. MANBECK, JR.

*Attesting Officer*

*Commissioner of Patents and Trademarks*